United States Patent [19]

Safrit et al.

[11] 4,341,096

[45] Jul. 27, 1982

[54] SOCK WITH TRIPLE LAYER FABRIC IN FOOT AND METHOD

[75] Inventors: Sam C. Safrit, Pfafftown; Roscoe M. Farrell, Pittsboro; Harper Shields, Burlington, all of N.C.

[73] Assignee: Kayser-Roth Hosiery, Inc., Burlington, N.C.

[21] Appl. No.: 175,932

[22] Filed: Aug. 6, 1980

[51] Int. Cl.[3] ..... A41B 11/02; D04B 7/04

[52] U.S. Cl. ..... 66/185; 66/187; 66/196; 2/239

[58] Field of Search ..... 2/239; 66/196, 185, 66/186, 187, 202, 178

[56] References Cited

U.S. PATENT DOCUMENTS

| | | | |
|---|---|---|---|
| 3,107,510 | 10/1963 | Maiger | 66/196 X |
| 3,264,846 | 8/1966 | Pfrommer | 66/196 |
| 3,307,379 | 3/1967 | Woolley et al. | 66/196 X |
| 3,721,111 | 3/1973 | Billi | 66/187 |
| 3,793,851 | 2/1974 | Thorneburg | 66/185 |
| 4,038,699 | 8/1977 | Burn | 66/178 R |

*Primary Examiner*—Ronald Feldbaum

*Attorney, Agent, or Firm*—Bell, Seltzer, Park & Gibson

[57] ABSTRACT

The triple layer fabric extends throughout at least a substantial portion of the foot portion and provides improved cushioning and moisture-absorbing characteristics thereto. The sock can be knit on a conventional hosiery knitting machine with very little modification being required. The inside and outside fabric layers of the foot are knit of hydrophobic yarn and the intermediate layer is knit at least in part of hydrophilic yarn so that moisture from the foot is wicked through the inner layer and into the intermediate layer where the moisture is absorbed and then wicked and evaporated through the outside layer. The triple layer in the foot of the sock maintains the foot of the wearer in a dry condition and provides cushioning for at least the ball and toes of the foot of the wearer.

16 Claims, 15 Drawing Figures

SOCK WITH TRIPLE LAYER FABRIC IN FOOT AND METHOD

FIELD OF THE INVENTION

This invention relates generally to a sock including a cushioning and moisture-absorbing foot and method of knitting the sock, and more particularly to such a sock and method which includes the knitting of triple layer fabric in the foot portion to impart improved cushioning and moisture-absorbing characteristics thereto.

BACKGROUND OF THE INVENTION

It is known to knit terry loops in socks to provide cushioning in the foot. It is also known to provide moisture-absorbing characteristics in socks by knitting different types of yarns on the inner and outer surfaces of a sock. For example, U.S. Pat. No. 3,250,095 discloses knitting terry loops of hydrophobic yarn, such as Orlon, extending inwardly on the inside surface of the sock and knitting hydrophilic yarn, such as cotton, on the outside surface of the sock so that perspiration is wicked away from the skin by the hydrophobic terry loops and absorbed by the hydrophilic yarn on the outer surface of the sock. This sock is knit with a single fabric layer and the cushioning and moisture-absorbing characteristics of this type of sock can be impeded when the terry loops are flattened by wear and when the hydrophilic yarn on the outer surface becomes saturated.

SUMMARY OF THE INVENTION

With the foregoing in mind, it is an object of the present invention to provide a sock and method which includes the knitting of triple layer fabric in the foot portion to provide improved cushioning and moisture-absorbing characteristics therein. The triple layer fabric extends throughout at least a substantial portion of the foot and throughout the toe area or pocket of the sock. The inside fabric layer is preferably knit of a hydrophobic yarn, such as olefin, the intermediate layer is knit at least in part of a hydrophilic yarn, such as cotton, and the outer layer is also knit of a hydrophobic yarn, such as nylon. The inner layer is positioned adjacent the foot and toes of the wearer and wicks the moisture into the intermediate layer where the moisture is absorbed and then wicked and evaporated through the outside layer. The triple layer foot of the sock maintains the foot of the wearer in a dry condition and provides cushioning for at least the ball and toes of the foot of the wearer.

In accordance with the present invention, the rear ends of the triple layer fabric in the foot are integrally knit together and joined to the remainder of the sock and the forward ends are joined together by a toe closure seam of appropriate configuration. The triple layer fabric in the foot of the sock is integrally knit in a continuous knitting operation on a circular hosiery knitting machine and the completion of the sock requires only the formation of a curved seam to form a "fishmouth" type toe pocket with the closure seam extending around the outer ends of the toes of the wearer.

The triple layer fabric in the foot can be provided in a tube sock of the "heelless" type, as illustrated in the drawings, or it may be provided in a sock with a conventional type of reciprocatorily knit heel pocket. The triple layer fabric may extend rearwardly to a position immediately adjacent the heel of the wearer, or the triple layer fabric may extend rearwardly throughout the entire foot and heel area and terminate at the ankle of the wearer.

BRIEF DESCRIPTION OF THE DRAWINGS

Other objects and advantages will appear as the description proceeds when taken in connection with the accompanying drawings, in which.

DESCRIPTION OF THE EMBODIMENT OF FIGS. 1–12

Figure 1:
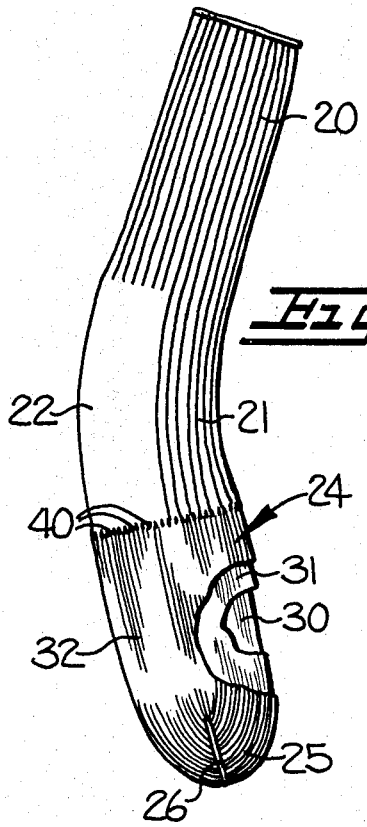
FIG. 1 is an elevational view of one embodiment of the sock of the present invention in flattened condition and with portions of the foot broken away to show the triple layer fabric.
Figure 2:
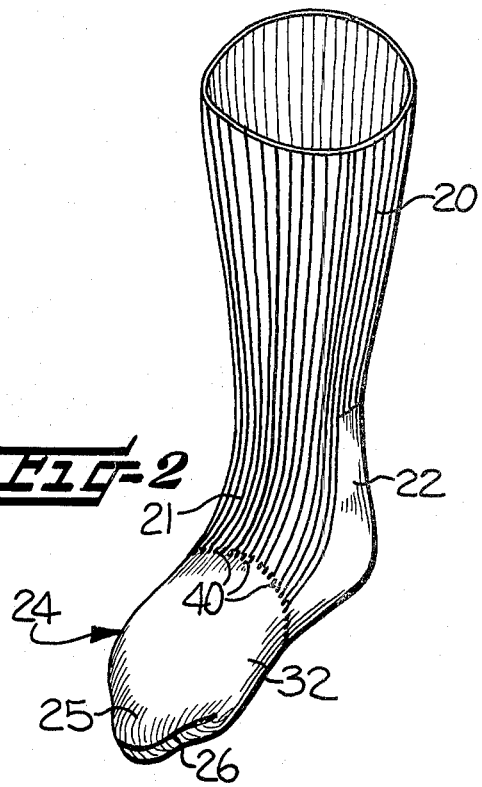
FIG. 2 is a perspective view of the sock of FIG. 1, showing the appearance of the sock when worn.

The sock of the present invention, as illustrated in FIGS. 1–12, includes a leg 20 knit of successive courses including a predetermined number of stitch loops forming wales in the successive courses. The leg 20 is preferably of the "mock rib" type which is formed in the well-known manner by inlaying an elastic yarn in spaced-apart wales, such as every fourth wale, and floating the elastic yarn inside of the intervening three wales to provide the mock rib appearance. The mock rib of the leg 20 is continued and integrally knit with a foot portion, broadly indicated at 24, and includes an instep area 21 positioned opposite a "patch" type heel area 22. The patch heel area 22 is formed by knitting the elastic yarn to form additional partial courses and provide a slightly curved configuration to the heel 22 of the sock. If desired, terry loops may be formed on the inner surface of the patch heel 22, as indicated at 23 in FIG. 4. The foot portion 24 also includes a toe area 25 which includes a closure seam 26 formed to extend around the ends of the toes of the wearer, as illustrated in FIG. 2.

Figure 4:
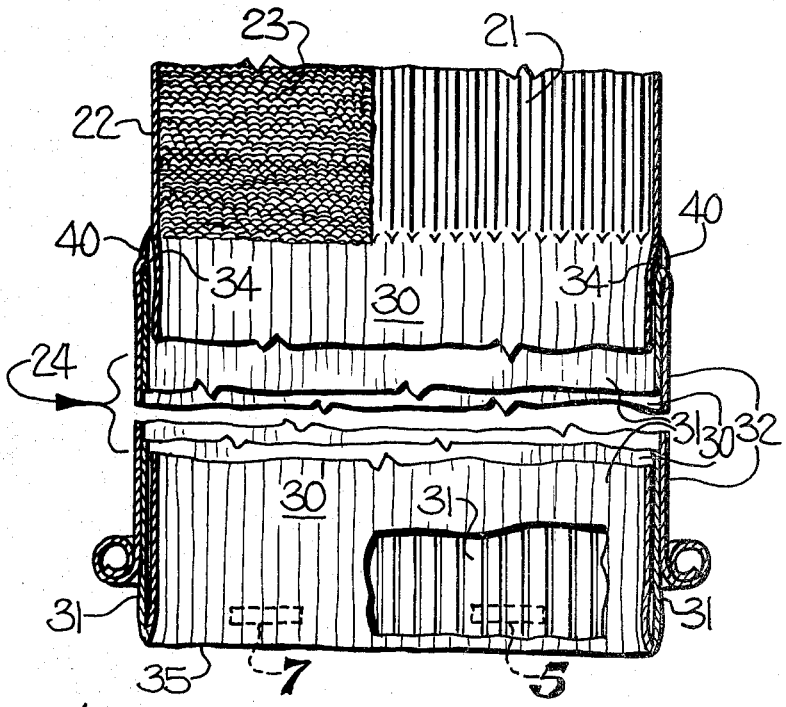
FIG. 4 is an enlarged fragmentary cross-sectional view of the lower portion of the sock of FIG. 3 with the central portion broken away and illustrating the relationship between the three layers of fabric before the toe closure seam is formed.
Figure 7:
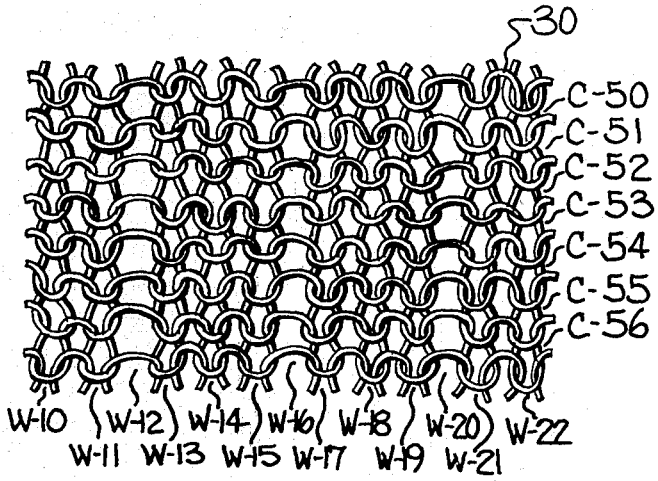
FIG. 7 is a view similar to FIGS. 5 and 6 but illustrating the stitch construction of the fabric of the inside layer, being taken in the dotted rectangle 7 in FIG. 4.
Figure 8:
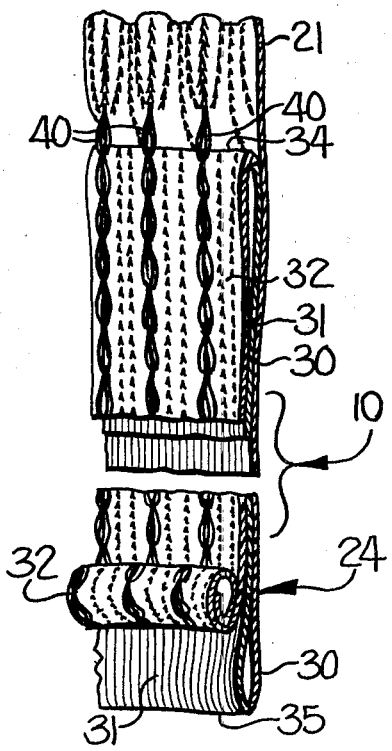
FIG. 8 is a fragmentary elevation, with portions in cross-section, illustrating the manner in which the three fabric layers are integrally knit in the sock blank.

The cushioning and moisture-absorbing triple layer fabric extends throughout at least a substantial portion of the foot 24 and throughout the toe pocket 25. The triple layer fabric includes an inner or inside layer 30, an intermediate or middle layer 31, and an outer or outside layer 32. Each of the layers 30, 31 and 32 includes forward ends connected together by the toe pocket closure seam 26 and each of the layers also includes rear or upper end portions. As illustrated in FIGS. 4 and 8, the rear or upper end portion of the inner layer 30 is integrally knit with and forms a continuation of the instep 21 and patch heel 22 of the foot 24. Also, the inner layer 30 includes a lesser number of wales than the leg 20, instep 21 and heel 22, as illustrated in FIG. 7 where floats are formed in wales W-12, W-16 and W-20 while stitch loops are formed in the three adjacent wales therebetween.

Figure 3:
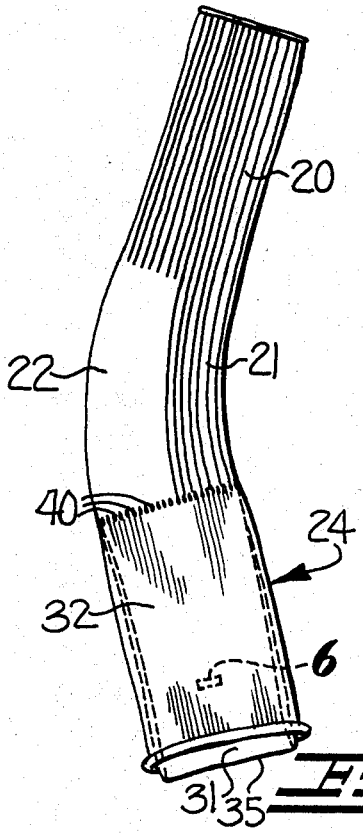
FIG. 3 is an elevational view of the sock blank, as it appears when the knitting is completed.
Figure 5:
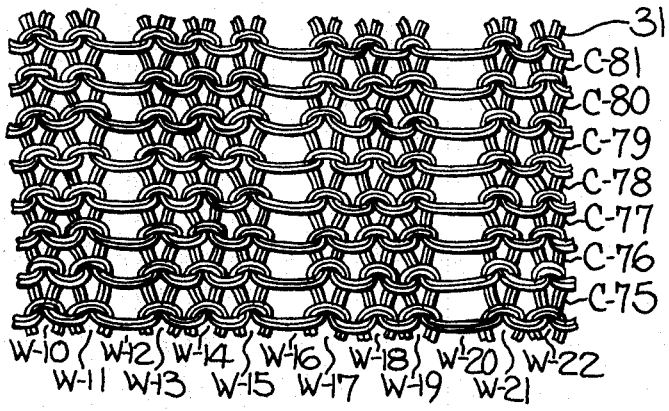
FIG. 5 is an enlarged elevational view of a small portion of the fabric of the intermediate layer, being taken substantially in the dotted rectangle 5 in FIG. 4.

The rear or upper ends of the intermediate layer 31 and the outer layer 32 are joined together along a fold line, indicated at 34 in FIGS. 4 and 8. In the stocking blank, before forming the toe closing seam 26, the forward or lower ends of the inner layer 30 and the intermediate layer 31 are joined together along a fold line indicated at 35 in FIGS. 4 and 8. As illustrated in FIG. 5, the intermediate layer 31 includes the same number of wales as the inner layer 30 and floats are formed in wales W-12, W-16 and W-20 while stitch loops are formed in the three adjacent wales between the floats. The rear or upper end of the outer layer 32, along the fold line 34, is joined to the instep 21 and the heel 22 of the foot 24 by spaced apart held stitch loops 40 (FIGS. 4 and 8). The held stitch loops extend completely around the foot 24 of the sock, as illustrated in FIGS. 1–3. These spaced-apart connecting stitch loops 40 are held on the corresponding needles upon the completion of the knitting of the instep 21 and the heel 23 and during the entire knitting of the inner layer 30 and the intermediate layer 31, in a manner to be presently described.

Figure 6:
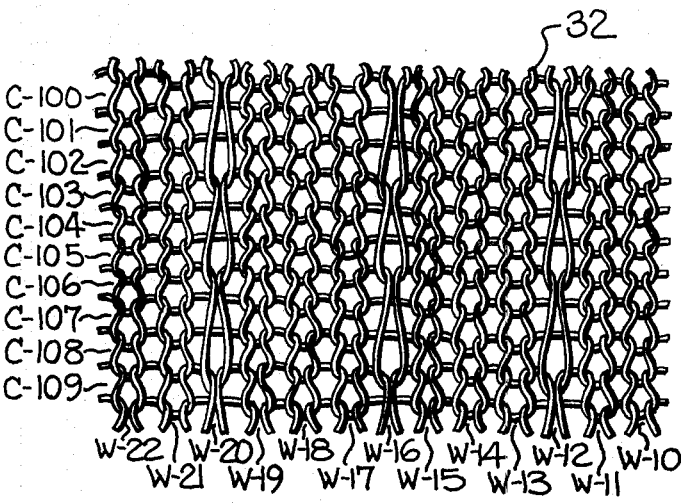
FIG. 6 is a view similar to FIG. 5 but illustrating the stitch construction in a small area of the fabric of the outer layer, being taken in the dotted rectangle 6 in FIG. 3.

The outer layer 32 includes the same predetermined number of wales as the leg 20, the instep 21 and the heel 22 and includes stitch loops in the wales W-12, W-16 and W-20, as illustrated in FIG. 6. However, the stitch loops in the wales W-12, W-16, and W-20 are elongated and extend over three courses while the stitch loops in the groups of adjacent three wales therebetween are formed in every course. The enlarged or elongated stitches in the spaced apart wales form ornamental longitudinal lines along the outer surface of the outer layer 32, as best illustrated in FIG. 8. The elongated stitch loops formed in wales W-12, W-16, and W-20 of courses C-100, C-103 and C-106 are held during the knitting of the intervening courses in which floats are formed in the wales W-12, W-16 and W-20, as illustrated in FIG. 6.

The provision of the triple layer fabric in the sole and lower instep of the foot 24 and toe 25 provides enhanced cushioning of the foot and toes of the wearer because the three distinct layers 30, 31 and 32 provide a better cushioning than has heretofore been provided in socks including conventional terry loops. Also, the triple layer construction enhances the moisture-absorbing characteristics of the foot 24 and toe 25 of the sock when the inner layer 30 and the outer layer 32 are both knit of hydrophobic yarn and the intermediate layer is knit at least in part of a hydrophilic yarn. With this type of construction, the perspiration or other moisture is wicked away from the skin of the foot by the inner layer 30, is absorbed by the intermediate layer 31, and is readily evaporated from the intermediate layer 31 and through the outer layer 32.

Figure 12:
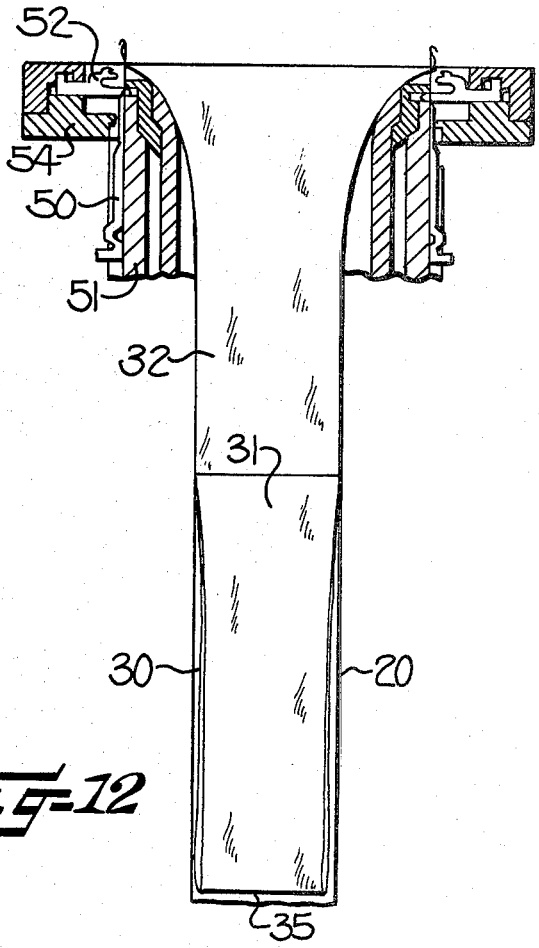

When knitting of the sock blank is completed, the inner layer 30 and intermediate layer 31 are disposed inside of the leg 20, instep 21 and heel 22, as shown in FIG. 12 and to be presently described. To complete the sock, the inner layer 30 and the intermediate layer 31 are drawn downwardly inside of the outer layer 32, to the position illustrated in FIGS. 3 and 4. The sock is then flattened with the portion encompassing the instep 21 comprising one half and the portion comprising the heel 22 comprising the other half and a curved seam 26 is formed around the end of the three layers of fabric. The seam 26 is formed with the conventional type of overedge seaming machine which also cuts away the surplus fabric as the seam is formed. The socks are then finished in the usual manner, which usually includes washing, dyeing, and boarding.

Method of Knitting

As illustrated in FIGS. 9–12, the sock of the present invention is knit on a conventional hosiery knitting machine having needles 50 supported for vertical sliding movement in the slots of a needle cylinder 51. Sinkers 52 cooperate with the needles 50 in forming the successive courses of stitch loops and are supported for radial movement in radial slots in a sinker head 54. A specific example of the knitting of a light-weight dress type sock will be described when knit on a 200-needle machine with four yarn feeding and knitting stations. However, it is to be understood that the sock of the present invention may be knit on other types of machines, and using other types of yarn than those specifically described.

Figure 9:
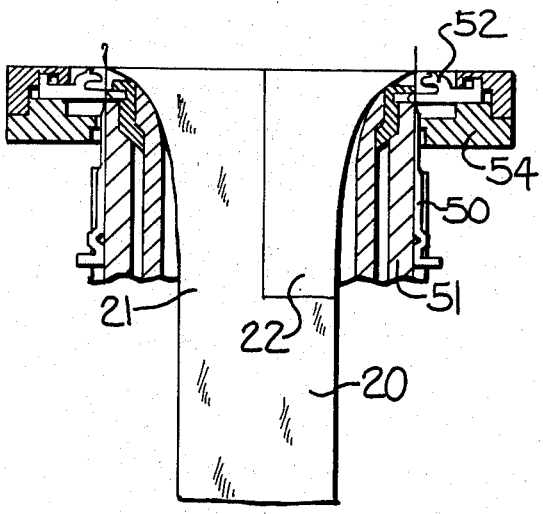
FIGS. 9 through 12 are somewhat schematic cross-sectional views through the needle cylinder of a conventional type hosiery knitting machine and schematically illustrating the progressive knitting of the various portions of the sock.

The knitting begins at the upper end of the leg 20 by knitting a conventional selvage edge and make-up and then knitting a few courses to form a cuff while knitting two ends of 100/34 denier stretch nylon yarn and inlaying a 240 denier covered Lycra yarn in every fourth wale of every other course. The remaining portion of the leg 20 is knit with four feeds knitting and feeding the same type of two ends of 100/34 denier stretch nylon yarn at three of the feeds while inlaying an 85 denier covered Lycra yarn at the other feed. When knitting the patch heel 22 and instep 21 of the foot 24, the Lycra yarn is still inlaid in the upper instep portion 21 to form the mock rib appearance. In the patch heel 22 the Lycra yarn is knit, with a reinforcing yarn, to form additional partial courses in the patch heel 22 while terry loops 23 are formed over the nips of the sinkers in the well-known manner. At this point the leg 20, upper instep 21 and patch heel 22 of the foot 24 are completed, as illustrated in FIG. 9.

Figure 10:
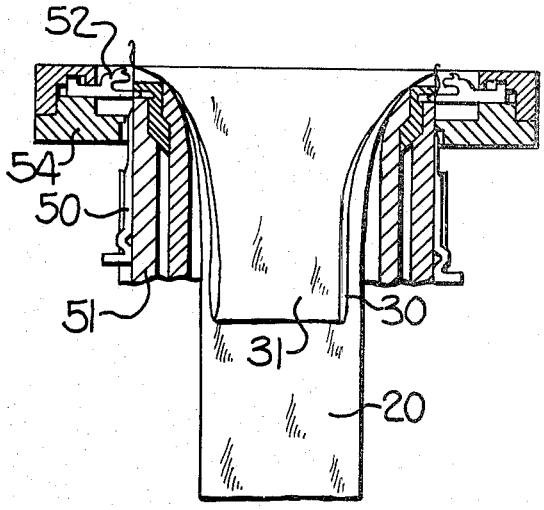

During the knitting of the inside layer 30, as illustrated in FIG. 10, every fourth needle 50 is moved to a lowered inactive position and holds the corresponding last stitch loops formed in the heel 22 and instep 21 until completion of the knitting of the inside layer 30 and the intermediate layer 31, while the remaining needles continue to knit, as illustrated in FIG. 7. The inside layer is knit with three yarn feed and knitting stations operating and one end of $2\times80$ olefin dye resist yarn is fed at each of the three knitting stations until the proper length is knit to form the inside layer 30.

Figure 11:
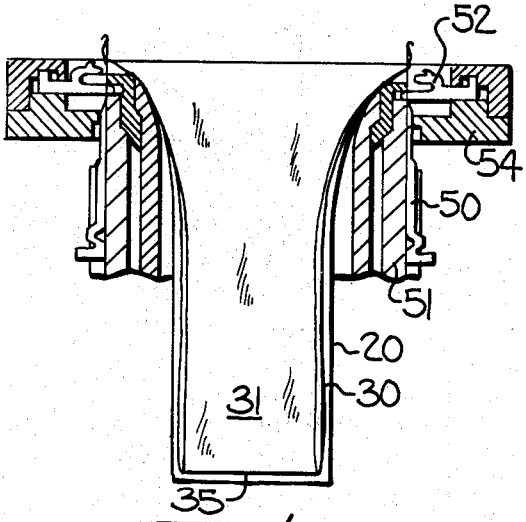

The middle or intermediate layer 31 is then knit, as illustrated in FIG. 11, and in the same manner as the inside layer 30 but one end of 50/1 cotton yarn and one end of 100/34 stretch nylon are knit in plated relationship at each of the three feeding stations until the same length of fabric has been knit as was knit to form the inside layer 30. Upon completion of the knitting of the intermediate layer 31, every fourth inactive needle is brought back into active position and the outside layer 32 is knit with all four knitting and feeding stations operating and while feeding two ends of 100/34 denier stretch nylon at each station and forming stitch loops on every fourth needle during the knitting of each third course to form the longitudinal lines of elongated stitches, as illustrated in wales W-12, W-16 and W-20 of FIG. 6. Upon completion of the knitting of the stocking blank, as illustrated in FIG. 12, the sock blank is removed from the knitting machine and the inside layer 30 and integrally knit middle or intermediate layer 31 are drawn downwardly into juxtaposition with and inside of the outer layer 32, as illustrated in FIG. 3. The sock is then completed by forming the toe closure seam 26, in the manner previously described.

The completed sock is thus provided with an inner layer 30 knit entirely of a hydrophobic yarn, an outer layer 32 knit entirely of hydrophobic yarn, and an intermediate layer 3; sandwiched therebetween and knit at least partially of a hydrophilic yarn. The triple layer fabric in the foot portion provides a comfortable cushion for the foot and also provides enhanced moisture-absorbing and evaporating means for perspiration from the foot of the wearer.

DESCRIPTION OF THE EMBODIMENT OF FIGS. 13–15

Figure 13:
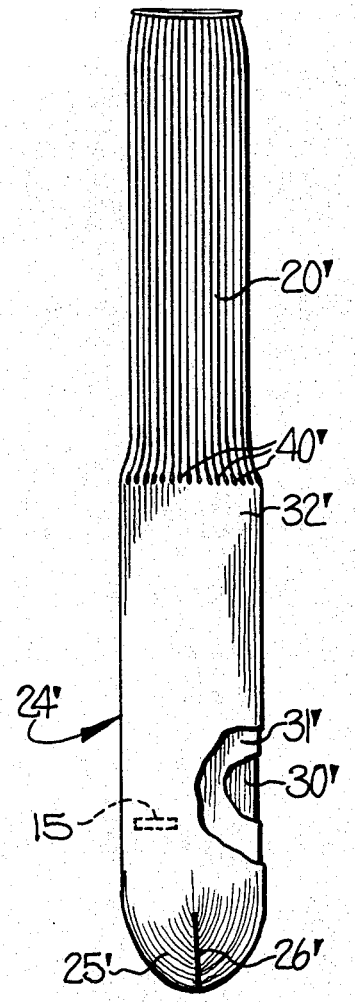
FIG. 13 is an elevational view of a second embodiment of the sock of the present invention in flattened condition and with portions of the foot broken away to show the triple layer fabric.
Figure 14:
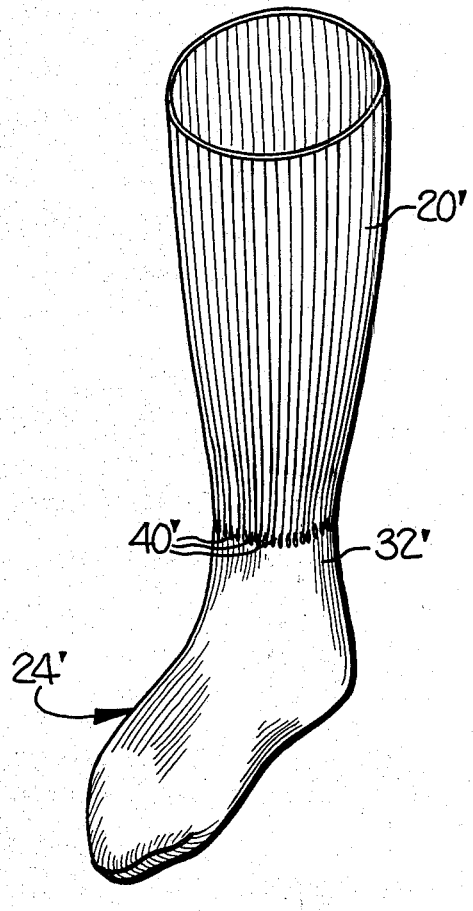
FIG. 14 is a perspective view of the sock of FIG. 13, showing the appearance of the sock when worn.
Figure 15:
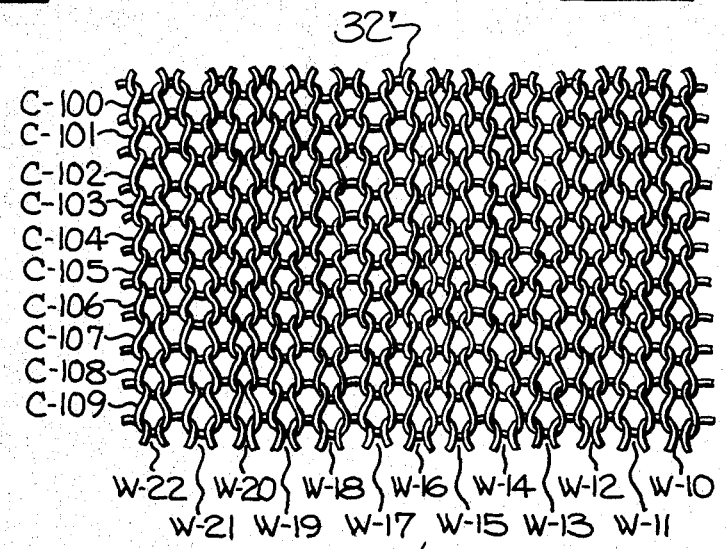
FIG. 15 is an enlarged elevational view of a small portion of the fabric of the outer layer, being taken substantially in the dotted rectangle 15 in FIG. 13.

The embodiment of the sock of the present invention illustrated in FIGS. 13–15 includes the same basic parts as the first embodiment of the sock and corresponding parts will bear the same reference characters with the prime notation added. However, this embodiment of the sock includes a triple layer foot 24' with the rear or upper ends of the inner layer 30', the intermediate layer 31' and the outer layer 32' extending up to and being joined to the leg 20' at a point above the heel and extending around the ankle, as illustrated in FIG. 14. This embodiment of the sock is normally of a coarser gauge than the first embodiment and is normally used for active participator sports, of the type known as athletic socks. This sock also includes the spaced-apart held stitch loops 40' connecting and joining together the upper ends of the intermediate layer 31' and the outer layer 32' to the lower end of the leg 20'. The inner layer 30' and the intermediate layer 31' are knit in the same manner as the corresponding layers of the first embodiment of the sock, however, the outer layer 32' of this sock does not include the held or elongated stitches in spaced-apart wales but the outer layer 32' is knit with plain stitch loops being formed in each wale of every course, as illustrated in FIG. 15.

As a specific, but nonlimiting, example, the leg 20' is knit with a 12/1 cotton yarn and two ends of 100/34 denier stretch nylon knit in plated relationship and with a 240 denier covered Lycra yarn inlaid in spaced-apart courses to form the mock rib appearance. The inner layer 30' is knit with two ends of 100/34 stretch nylon knit at one feed and alternating with one end of 1/15 acrylic at the other feed and with plain stitch loops being formed in every wale of every course at each of the knitting stations. The intermediate layer 31' is knit with two knitting stations operating and with one end of 12/1 cotton yarn and two ends of 100/34 stretch nylon being knit at each knitting station and knit in plated relationship with each other in three adjacent wales and while forming floats across the every fourth wale. The outside layer 32' is knit with three yarn feeding and knitting stations operating and with two ends of 100/34 stretch nylon being fed at each of the knitting stations and all needles operating to knit a plain fabric on the outside layer 32'.

Upon completion of the knitting of the sock, the inner and intermediate layers 30', 31' are turned down inside of the outside layer 32' and the toe closure seam 26' is formed to complete the toe pocket 25'. The sock may then be further processed by washing, bleaching, boarding and the like.

In the embodiment of the sock illustrated in FIGS. 1–12, the triple layer foot 24 extends upwardly to the heel pocket or rearwardly of the foot throughout at least a substantial portion of the foot of the wearer. In the embodiment of the sock illustrated in FIGS. 13–15, the triple layer foot 24' extends over the heel and upwardly to a position surrounding the ankle of the wearer. In both instances, the triple layer fabric provides enhanced cushioning to the foot of the wearer and also provides enhanced moisture absorbing characteristics to the sock.

In the drawings and specification there has been set forth the best mode presently contemplated for the practice of the present invention, and although specific terms are employed, they are used in a generic and descriptive sense only and not for purposes of limitation, the scope of the invention being defined in the claims.

That which is claimed is:

1. In a sock including a leg portion knit of successive courses including a predetermined number of stitch loops forming wales in successive courses, and a foot portion knit integral with said leg, said foot portion including toe, heel, sole, and upper and lower instep areas with said toe area including a closure seam, the improvement wherein at least a substantial portion of said foot portion is provided with improved cushioning characteristics and comprises triple layer fabric including an inner layer, an intermediate layer, and an outer layer each including forward ends connected together by said toe portion closure seam and rear portions integrally knit with the remainder of the sock.

2. A sock according to claim 1 wherein said inner and intermediate layers include an equal number of wales which is less than the number of wales in said leg, said rear end portions of said intermediate layer and said outer layer being joined along a fold line connected to the remainder of the sock by spaced-apart held stitch loops, and wherein said outer layer includes the same number of wales as said leg.

3. A sock according to claim 1 including moisture-absorbing characteristics and wherein said inner and outer layers are knit of hydrophobic yarn, and wherein said intermediate layer is knit at least in part of hydrophilic yarn so that moisture from the foot of the wearer is wicked through said inner layer and into said intermediate layer and then wicked and evaporated through said outside layer.

4. A sock according to claim 3 wherein said intermediate layer is knit of hydrophobic and hydrophilic yarns in plated relationship.

5. In a sock including a single layer leg portion knit of successive courses including a predetermined number of stitch loops forming wales in successive courses, and a foot portion knit integral with said leg, said foot portion including toe, heel, sole and upper and lower instep areas with said toe area including a closure seam, the improvement wherein at least a substantial portion of said foot portion is provided with improved cushioning and moisture-absorbing characteristics and comprises triple layer fabric including an inner layer knit of hydrophobic yarn, an intermediate layer knit at least in part of hydrophilic yarn, and an outer layer knit of hydrophobic yarn, each of said layers including forward ends connected together by said toe portion closure seam and rear portions integrally knit with the remainder of the sock.

6. A sock according to claims 1 or 5 wherein heel and upper instep areas are also single layer fabric, and wherein said inner, intermediate and outer layers extend rearwardly with their rear ends being integrally knit with said single layer heel and upper instep areas.

7. A sock according to claims 1 or 5 wherein said inner, intermediate, and outer layers extend rearwardly throughout said heel and upper instep areas and are integrally knit with said leg.

8. A sock according to claims 1 or 5 wherein said outside layer includes longitudinal lines of elongate stitches in spaced-apart wales, said elongated stitches extending over at least two courses.

9. A sock blank including a single layer leg knit of successive courses including a predetermined number of stitch loops forming wales in said successive courses, a foot portion knit integral with said leg and comprising triple layer fabric extending throughout at least a substantial portion of said foot portion, said triple layer fabric including an inner layer, an intermediate layer, and an outer layer, each of said layers including rear and forward ends, said rear end of said inner layer being integrally knit with the remainder of the sock, said inner layer including a lesser number of wales than said leg, said rear ends of said intermediate layer and said outer layer being joined along a fold line, said intermediate layer including the same number of wales as said inner layer, said fold line joining said middle and said outer layers being connected to the remainder of the sock by spaced-apart held stitch loops, said outer layer including the same number of wales as said leg, said forward ends of said inner and said intermediate layers being joined along a fold line, and said forward ends of each of said layers terminating in substantial alignment so that a toe closure seam may be formed to join all three layers together and form a toe pocket.

10. A sock blank according to claim 9 wherein said foot portion includes toe, heel, sole, and upper and lower instep areas, wherein said heel and upper instep areas comprise single layer fabric, and wherein said triple layer fabric extends rearwardly throughout said sole and lower instep areas with the rear ends thereof being integrally knit with said single layer heel and upper instep areas.

11. A sock blank according to claim 9 wherein said foot portion includes toe, heel, sole, and upper and lower instep areas, and wherein said triple layer fabric extends rearwardly and throughout the entire foot portions with the rear ends thereof being integrally knit with said single layer leg.

12. A method of forming a sock with cushioning triple layer fabric extending throughout at least a substantial portion of the foot, said method comprising the steps of knitting a leg of successive courses including a predetermined number of stitch loops forming wales in said successive courses, knitting an inner layer of the foot while holding stitch loops in certain spaced apart wales of said leg and forming stitch loops in the remaining wales, knitting an intermediate layer integral with said inner layer while continuing to hold stitch loops in said certain spaced apart wales, knitting an outer layer integral with said intermediate layer while knitting stitch loops in all wales to integrally join the beginning end of said outer layer to the terminal end of said intermediate layer, positioning said inner and said intermediate layers inside of said outer layer with the ends of said three layers remote from said leg being substantially aligned, and then cutting and seaming together the ends of the three layers and forming a closed toe area.

13. A method according to claim 12 including the step of knitting hydrophobic yarn to form said inner and outer layers, and knitting said intermediate layer at least in part of hydrophilic yarn to provide moisture-absorbing characteristics in at least a substantial portion of the foot of the sock.

14. A method according to claim 13 including the step of knitting said intermediate layer of hydrophobic and hydrophilic yarns in plated relationship.

15. A method according to claim 12 including the step of knitting elongate stiches in spaced apart wales and extending over at least two courses in said outside layer.

16. A method of knitting a sock blank on a circular hosiery knitting machine including a circle of needles, said sock including cushioning triple layer fabric extending throughout at least a substantial portion of the foot, said method comprising the steps of knitting a leg while forming stitch loops on all needles and knitting successive courses including a predetermined number of wales of stitch loops, knitting an inner layer of the foot while holding stitch loops on certain spaced apart needles and forming stitch loops on groups of adjacent needles between said certain needles, knitting an intermediate layer integral with said inner layer while continuing to hold stitch loops on said certain spaced apart needles, and then knitting an outer layer integral with said intermediate layer while knitting stitch loops on all needles to integrally join the beginning end of said outer layer to the terminal end of said intermediate layer.

* * * * *